US008851860B1

(12) United States Patent
Mail

(10) Patent No.: US 8,851,860 B1
(45) Date of Patent: Oct. 7, 2014

(54) ADAPTIVE CONTROL OF AN OIL OR GAS WELL SURFACE-MOUNTED HYDRAULIC PUMPING SYSTEM AND METHOD

(75) Inventor: Jacob Mail, Northridge, CA (US)

(73) Assignee: Tundra Process Solutions Ltd., Calgary, Alberta (CA)

( * ) Notice: Subject to any disclaimer, the term of this patent is extended or adjusted under 35 U.S.C. 154(b) by 1027 days.

(21) Appl. No.: 12/661,234

(22) Filed: Mar. 12, 2010

Related U.S. Application Data

(60) Provisional application No. 61/210,926, filed on Mar. 23, 2009.

(51) Int. Cl.
*F04B 49/00* (2006.01)

(52) U.S. Cl.
USPC ..... 417/47; 417/390; 417/903; 166/68; 166/105

(58) Field of Classification Search
USPC ..... 417/166, 53, 63, 46, 47, 390, 903; 166/68, 105
See application file for complete search history.

(56) References Cited

U.S. PATENT DOCUMENTS

| | | | | |
|---|---|---|---|---|
| 4,400,141 | A * | 8/1983 | Lee et al. | 417/360 |
| 4,406,122 | A * | 9/1983 | McDuffie | 60/368 |
| 4,848,085 | A * | 7/1989 | Rosman | 60/372 |
| 5,193,985 | A | 3/1993 | Escue et al. | |
| 5,281,100 | A * | 1/1994 | Diederich | 417/18 |
| 5,314,016 | A * | 5/1994 | Dunham | 166/250.15 |
| 5,878,817 | A * | 3/1999 | Stastka | 166/372 |
| 5,941,305 | A | 8/1999 | Thrasher et al. | |
| 6,041,856 | A | 3/2000 | Thrasher et al. | |
| 6,213,722 | B1 | 4/2001 | Raos | |
| 6,460,622 | B1 * | 10/2002 | Rice | 166/369 |
| 7,218,997 | B2 * | 5/2007 | Bassett | 700/286 |
| 8,083,499 | B1 * | 12/2011 | Krug et al. | 417/390 |
| 2004/0149436 | A1 | 8/2004 | Sheldon | |
| 2006/0032533 | A1 | 2/2006 | Sheldon | |
| 2009/0055029 | A1 | 2/2009 | Roberson et al. | |

FOREIGN PATENT DOCUMENTS

| | | |
|---|---|---|
| GB | 2 344 911 | 6/2000 |
| WO | WO 01/16487 | 3/2001 |

* cited by examiner

*Primary Examiner* — Devon Kramer
*Assistant Examiner* — Charles W Nichols
(74) *Attorney, Agent, or Firm* — Thomas I. Rozsa

(57) ABSTRACT

The disclosed invention provides intelligent adaptive control for optimization of production output, energy efficiency and safety of a linear reciprocating long stroke hydraulic lift system, for use at the surface of oil and gas wells to extract fluids or gas after free flowing stopped due to natural decline of reservoir pressure.

The hydraulic pump and its adaptive control system introduced in this invention are capable of optimizing its production capacity by varying multiple operating parameters, including its stroking length and speed characteristics continuously and instantaneously at any point. Merits and benefits of this invention include significant increase in production efficiency, improved durability and longevity of the pumping equipment, significant power consumption savings and an ability to adapt effectively to changing well conditions.

1 Claim, 7 Drawing Sheets

ADAPTIVE CONTROL OF AN OIL OR GAS WELL SURFACE-MOUNTED HYDRAULIC PUMPING SYSTEM AND METHOD

This patent application claims priority to Application No. 61/210,926 filed on Mar. 23, 2009.

BACKGROUND OF THE INVENTION

1. Field of the Invention

This invention relates to artificial lift of fluids and gas from subsurface reservoirs. More specifically it relates to performance optimization of fluid and gas artificial recovery from subsurface formations, using a surface mounted reciprocating hydraulic pump, controlled by a computer and a set of specific algorithms.

2. Description of Prior Art

Flow into a petroleum well bore depends upon the characteristics of the reservoir formation and its fluids. It also depends upon the well bore conditions while it is producing. Petroleum well characteristics undergo changes during the operating life of the well, some of which the well operator can manage directly while others can be hardly controlled. After an initial phase of free flowing production and as reservoir pressure is declining, there is a need to employ artificial means to continue to recover fluid. A variety of techniques and equipment have been developed over time to extract oil and gas from subsurface formations.

A mainstream method to recover fluid from the ground is rod lifting. This method features a subsurface downhole pump immersed in a casing tube and attached via a rod string to a surface mounted reciprocating mechanism. The reciprocating mechanism, hereinafter defined as the surface pump, is lifting a column of fluid and gas in each stroking cycle. The most conventional and recognized rod lifting pump is the "horse head" beam pump.

The operating characteristics of the lifting system determine its economic efficiency, namely its production capacity and its operating costs. Pumping speed is a critical operating parameter in determining the overall lifting system efficiency. Ideal pumping occurs when the inflow rate of the well equals the pumping rate, with the downhole pump being fully submerged in fluid, allowing complete filling of the downhole pump on every stroke. In other words, ideal pumping occurs when the fluid level in the well bore is maintained close above the top of the downhole pump during operation.

Optimal speed on the up stroke can be defined as the maximum speed that will not cause (a) pumped off condition of the well, or (b) overstressing of the rod string and its associated structural components. Maximum speed on the upstroke also minimizes the leakage of produced oil, thereby increasing production efficiency.

Optimal speed on the down stroke can be defined as the maximum speed which will not cause floating of the polished rod. Floating of the polished rod on the down stroke can cause separation of the polished rod from the carrier bar, leading to uncontrolled impact loads between them when they come back together on the up stroke. Acceleration and deceleration of the fluid column and the moving parts of the lifting system during motion and specifically during turnaround determine the magnitude of dynamic loads and resultant stresses on the structural parts of the pump.

Operation at speeds lower than the optimal speed causes loss of production. Operation at higher than the optimal speed causes pumped off conditions, with partial fillage of the downhole pump. Operation in pumped off conditions is causing pounding loads between the pumping equipment and the fluid, resulting in overstressing of structural parts, their premature damage, high maintenance costs and a shortened life of the pumping equipment.

There is a need to develop a mechanism which can control closely the position, velocity and acceleration of a rod lifting system at any point in real time.

Prior art has been utilizing open loop control, fixed set point control or simple closed loop feedback control to manage performance of typical oil lifting machines such as the traditional beam pump. Traditional beam pumps operate on the basis of a four bar linkage geometry. In a typical beam pump embodiment the circular motion of a crank arm, driven by an electric motor or a combustion engine, is converted into reciprocating motion of the polished rod. The position, velocity and acceleration sinusoidal characteristics of the polished rod are very complicated and are, therefore, hard to control by the crank arm drive in real time. The difficulty to control these parameters is greatly compounded by typical large dynamic inertias of the moving parts of the beam pump and its balancing weights.

Present technology features a great variety of sensor readings and control devices that enable to monitor numerous well data. However, operator's intervention, either at the factory or in the field, has always been required to adjust parameter settings, in response to varying operating conditions and in order to improve performance and production efficiencies of the lifting system.

Adjustment of the stroke length of a beam pump is an example of typical need for operator's intervention when changing pumping parameters. A beam pump stroke is adjusted by physically removing and replacing its arms length. Another example is speed adjustment methods in reaction to varying load conditions. Up stroke and down stroke conditions vary during operation, requiring adjustments of the upstroke speed, the down stroke speed or both. Present technology requires operator's intervention to adjust these speeds. Moreover, most present technologies do not enable to set different up and down speeds, as optimization of pumping performance often requires.

In extreme cases, like rod parting, safe stoppage is required. Most systems are not smart enough to "safe land" the system softly without causing major damage, costly maintenance and wasted production down time.

Oil fields are characterized by being located most often in remote and hard to access sites. There is a need to improve the ability to monitor and manage oil pump performance in order to improve its productivity and react timely to hazardous conditions without the need to employ physical intervention of an operator.

The following ten issued patents and published patent applications are the closest prior art known to the present inventor which relate to the field of the present invention:

1. U.S. Pat. No. 5,193,985 issued to Nelson Escue et al. and assigned to UniFlo OilCorp., Ltd. on Mar. 16, 1993 for "Pump Control System For A Down Hole Motor-Pump Assembly And Method of Using Same" (hereafter the "Escue patent");
2. U.S. Pat. No. 5,941,305 issued to William R. Thrasher et al. and assigned to Patton Enterprises, Inc. on Aug. 24, 1999 for "Real-Time Pump Optimization System" (hereafter the "'305 Thrasher Patent");
3. U.S. Pat. No. 6,041,856 issued to William B. Thrasher et al. and assigned to Patton Enterprises, Inc. on Mar. 28, 2000 for "Real-Time Optimization System" (hereafter the "'856 Thrasher Patent");

4. U.S. Pat. No. 6,213,722 issued to Davor Jack Raos on Apr. 10, 2001 for "Sucker Rod Actuating Device" (hereafter the "Raos Patent");
5. United States Published Patent Application No. 2004/0149436 to Michael L. Sheldon on Aug. 5, 2004 for "System And Method For Automating Or Metering Fluid Recovered At A Well" (hereafter the "'0149436 Sheldon Published Patent Application");
6. United States Published Patent Application No. 2006/0032533 to Michael L. Sheldon on Feb. 16, 2006 for "System And Method For Automating Or Metering Fluid Recovered At A Well" (hereafter the "'0032533 Sheldon Published Patent Application");
7. United States Published Patent Application No. 2009/0055029 to Alan L. Roberson et al. and assigned to Lufkin Industries, Inc. on Feb. 26, 2009 for "Real-Time Onsite Internet Communication With Well Manager For Constant Well Optimization" (hereafter the "Roberson Published patent application);
8. UK Patent Application No. GB 2 344 910 to Paulo S. Tubel et al. and assigned to Baker Hughes Incorporated on Jun. 21, 2000 for "Method for Remote Control Of Wellbore And Devices" (hereafter the "'910 Tubel UK Patent Application);
9. UK Patent Application No. GB 2 344 911 to Paulo S. Tubel et al. and assigned to Baker Hughes Incorporated on Jun. 21, 2000 for "Method of Remote Control of Wellbore And Devices" (hereafter the "'911 Tubel UK Patent Application");
10. PCT Application No. WO 01/16487 to Ying Li on Mar. 8, 2001 for "A Pumping Unit" (hereafter the "Li PCT Application).

The Escue patent discloses a control system for monitoring and controlling the operation of a downhole linear DC motor-pump assembly. The system includes a surface monitoring station that is in radio communication with a plurality of remote downhole motor-pump assemblies. Each motor-pump assembly has a surface motor controller and a downhole motor-pump cartridge unit in a stationary position for pumping purposes. The motor-pump cartridge unit may be raised or lowered by a control cable within the production tubing for helping to facilitate the repair or replacement of the motor-pump cartridge unit. This does not disclose continuously monitoring the pump and also does not use a hydraulic piston but instead discloses use of a DC motor pump assembly.

The Raos patent discloses a method for pumping a fluid utilizing a sucker rod assembly and an electric linear motor and counterbalance which includes positioning the sucker rod pump assembly such that the pump contacts a fluid reservoir, positioning a linear control motor such that the axis of operation is substantially the same as the axis of movement of the sucker rod, attaching the top end of the sucker rod to the armature of the linear motor such that when operable, the armature directly drives the rod, providing a counterbalance positioned such that it alleviates the load imposed on the linear motor by the sucker rod and the column of fluid to be pumped, and operating the motor such that the pump acquires fluid on its down stroke and transports fluid on its up stroke. The patent discloses the concept of hydraulic pumping means and a feedback loop where pumping parameters are monitored by computer.

The '0149436 Sheldon Published Patent Application discloses a system and method for automating or metering fluid recovered at a well. The patent discloses:

"In the preferred embodiment, the control module 16 consists of a microprocessor-based controller 20 that provides the functions required for a variety of field automation applications that would enable local or remote monitoring, measurement and data archival, and control of the oil recovery device. For example, a Programmable Logic Controller (commonly known as PLC) could be used. One relatively inexpensive and currently available PLC is provided by Unitronics Industrial Automations Systems. Unitronics' PLC has sufficient processing ability, number of timers, memory, to control an oil recovery device and has the ability to provide bi-directional communications. Other controllers are also available and could be adapted for use in the present application. Such devices also include sufficient process inputs and outputs (I/Os) 22 for connecting the controller to the various electrical components of the oil recovery device. The benefit of the multiple I/Os is that it enables the module to connect to various devices for collecting measured and sensed data for controlling or diagnosing the operation of the oil recover system. In other words, the control module is used to automate the recovery system and allow for remote communication and control of the operation of the recovery system. For example the extractor unit uses a spool assembly to raise and lower a canister to collect oil in the well. Preferably a proximity sensor is used to monitor the rotation of the spool to measure and control the depth of the canister. Further, the limit switches, used to detect when the canister has been seated properly into the discharge head, are detected by the control module and are used to control both the motor and the compressor to pump the oil out of the canister. Timers within the control module (commonly provided with most PLCs) can also control the various aspects of the cycle, i.e., when and how long to run the compressor, how long to keep the canister at the top of the well before sending it down the well for another load, how long to keep the canister at a preselected depth to collect oil, etc. The control module also has the ability to tune the recovery process for optimal recovery as will be discussed below."

The '0032533 Sheldon Published Patent Application is a division of the above published patent application and has been abandoned. It has a similar concept as described above.

The Roberson Published patent application discloses:

"An apparatus and method for well control and monitoring including an independent web server computer integrated with a pump controller located at each well in an oil field. The well controller locally controls the well pump, processes well and pump data, generates surface and downhole cards, and communicates production reports, recommendations for production improvements, and production statistics to remote sites via the Internet. The controller can be queried remotely to provide production reports, etc. Furthermore, the controller can initiate alerts via email, text messaging, or internet messaging, for example, during fault conditions."

The '910 Tubel UK Patent discloses:

"A method for controlling a remotely located wellbore tool 29 between modes of operation comprises securing to the wellbore conduit string 13 the electrically actuatable wellbore tool 29, an acoustic sensor 25 and a digital circuit for examining the sensor output to produce a control signal to actuate the tool 29 if it detects that a sensed acoustic signal from a transmitter at the surface has a frequency which has been assigned specifically to the relevant tool. The acoustic transmission comprises pressure pulses passing down a column 55 of wellbore fluid and has a frequency assigned before lowering the string 13 into position in the wellbore. Each tool has one or more assigned frequencies which are programmed into the digital receiver circuit by an operator, using a handset."

The '911 Tubel UK Patent discloses:

"A method of communicating in a wellbore between a transmission node 45 and a reception node 47, through a fluid column 55 extending there between, comprises the method steps of providing a transmission apparatus 51 at said transmission node which is in communication with said fluid column, and providing a reception apparatus 53 at said reception which includes: (a) a sensor 25 which detects acoustic pulses, and (b) an electronic circuit which examines said acoustic pulses one at a time to determine whether or not they correspond to at least one predefined actuation frequency. The reception apparatus (FIG. 9 not shown) is used to monitor said acoustic transmission during predefined reception intervals associated with said at least one predefined actuation frequency to (1) provide an actuation signal if said acoustic transmission is determined to correspond to said at least one actuation frequency and (2) reset said electronic circuit if said acoustic transmission is determined to define some frequency other than said at least one predefined actuation frequency."

The Japanese WIPO patent discloses:

"The invention relates to a pumping unit comprising: a base (1) and a rack (2); an electric motor (17) varying frequency power for the pumping unit through a speed reducer (5); a driving hub (7A) connector said speed reducer (5) for driving a belt (10A) and the other belt (11) with one end connected with a balance weight box; a driven hub (7B) connected to said driving hub (7A) for driving a belt (10B) with one end attached to a sucker rod; an upper platform (3) in which said electric motor (17), said speed reducer (5), said driving hub (7A) said driven hub (7B) installed; a driving frequency converter (18) connected with a programmable controller (20) that is connected with an absolute value encoder (16) for dealing with running conditions of the pump unit. The pumping unit can be automatically controlled by the programmable controller with energy conversation, high efficiency and durability."

An example of an attempt to optimize the performance of an artificial lift system is taught in U.S. Pat. Nos. 5,941,305 and 6,041,856 Thrasher et al. These patents teach a control system of a typical progressive cavity pump, also known as a PCP. A PCP is a corkscrew fixed displacement downhole pump submersed in the well bore, driven by a surface mounted rotary drive, for example an electric motor. The surface mounted drive transfers torque to the rotor of the downhole PCP via sucker rods, "threading" up the well fluids. The fluid flow rate of the PCP is determined, among other parameters, by the speed that the surface mounted drive rotates the downhole pump's rotor. A plurality of sensors and load cells collect data from the well, the pump and the drive and feeds it to a PLC, where the data is compiled to provide an optimal speed command signal to the drive. The scope of the Thrasher inventions is centered on rotary corkscrew downhole pumps and the optimization of their performance via control of their rotational speed. Further, with respect to the monitoring and control system, only the speed of the motor is controlled. Although this concept teaches how to optimize artificial lift production, it is limited to rotary lifting technique, therefore it cannot be applied to the linear reciprocating lifting technique that is part of this invention, neither can it be applied to the broad range of functional and performance parameters that this invention enables to optimize. In addition, the pump and the control system disclosed in the Thrasher patents are subjected to premature failure of the downhole pump due to lack of lubrication and overheating when operating in gassy wells. They are also subjected to premature failure when operating in sandy wells due to surface erosion and damage by the abrasive sand contents in the fluid.

SUMMARY OF THE INVENTION

The disclosed invention provides intelligent adaptive control for optimization of production output, energy efficiency and safety of a linear reciprocating long stroke hydraulic lift system, for use at the surface of oil and gas wells to pump (a) oil, water and gas from oil wells, and (b) water from gas wells (dewatering) after free flowing stopped due to natural decline of reservoir pressure.

Unlike most traditional artificial lifting machines, the hydraulic surface pump and its adaptive control system introduced in this invention are capable of optimizing its production capacity by varying multiple operating parameters, including its stroking length and speed characteristics continuously and instantaneously at any point. Merits and benefits of this invention include significant increase in production efficiency, improved durability and longevity of the pumping equipment, significant power consumption savings and an ability to adapt effectively to changing well conditions.

The particular rod lifting system employed in this invention is comprised of a hydraulic, or a hydro-pneumatic, linear actuator (named hereinafter "Cylinder"), mounted vertically on a structural base and having a pulley and cable lift mechanism attached to its upper end, the cable attached to a rod string that is connected to a downhole pump. In a variety of embodiments the hydraulic cylinder can be a single acting cylinder, or a dual acting triple chamber cylinder, containing gas in one of its chambers and connected to multiple gas containers, counterbalancing the rod string gravity loads.

The improvement of the present invention involves the portion of the lifting system referred to as the surface pump. The components of the surface pump include a hydraulic linear cylinder, a pulley and cable assembly, the cable connected at one end to a polished rod, a source of power to drive the linear cylinder and a control unit to monitor and control the cylinder reciprocating motion.

The hydraulic cylinder is reciprocated up and down by a supply of hydraulic flow provided by a hydraulic pump. The hydraulic pump is operated by a primary drive, which can be an electric motor, or a combustion engine, the combustion engine fueled by natural gas or other fuel.

The adaptive control system of this invention, in conjunction with the aforementioned hydraulic lift system, enables the system to maximize fluid and gas productivity by optimizing the overall system production capacity. The pump's performance is optimized by using a computer, a plurality of sensing devices and a set of algorithms to continuously monitor and control the lifting system's functional parameters in real time and in a closed loop. The control system also embodies a plurality of well sensing devices, providing well data to the computer. The data collected by the computer is processed and used to control, for example, real time position of the cylinder piston rod, its stroke length and its direction, the speed, the acceleration and the deceleration of the cylinder at every point in each direction, loads on the structural components, etc. The collected data is also used to reduce stresses of structural parts, as well as to mitigate hazardous situations, thereby maximizing the longevity and safety of the lifting system as well as the subsurface equipment.

It is the objective of this invention to provide new means to enhance oil and gas well rod lifting capability.

A specific objective is to provide improved control means to optimize productivity of oil and gas well surface mounted hydraulic pumps.

Another specific objective is to provide means to detect and mitigate hazardous situations which may pose risk to the integrity of oil and gas well surface or subsurface pumping equipment, thereby to enhance its safety and durability and reduce its service and down time costs.

Another specific objective is to provide means to detect and mitigate operating conditions that may cause high stress of oil or gas well surface or subsurface pumping equipment, thereby to enhance its durability and longevity and further reduce its service and down time costs.

Another specific objective is to provide means to reduce the requirements of direct operator's intervention in controlling and adjusting the surface pump's settings.

The disclosed invention relies on the use of a sophisticated hydraulic lift system. Unlike conventional beam pumps typically used in rod lifting, this design enables unique operational control of the pump. Tight and simple control is enabled by unmatched responsiveness of the hydraulic system to a broad variety of input parameters, either separately or in conjunction with one and other. Its superior responsiveness is attributed to (a) the great compliance of hydraulic power and the relative low inertia loads of its moving parts compared to other artificial lift technologies, (b) the relative ease to control motion of a hydrostatic system without the need to modify, adjust or replace its primary hardware components, and (c) the simple linear relationship between input parameters, such as hydraulic flow and output parameters such as cylinder speed. Sensing devices monitor continuously the lifting system and well parameters. An electronic control unit compares them with desired results, subsequently feeding functional commands to the surface pump, in a real time, closed loop and interactive mode, to achieve the desired results. For example, position sensors which provide information on the cylinder's instantaneous position along its stroke can provide also interactive control of the cylinder position, up and down velocity, acceleration and deceleration, as well as its stroke length. Pressure sensors convert pressure readings into calculated loads, providing information on load changes, such as sudden change or loss of lifting loads, or excessive well friction. This allows the system to react instantaneously by slowing the cylinder, stopping it, or reversing its direction before harming itself. This invention uses sensors information in alone, or in combination with other information such as downhole pump data, load on the system, well output or similar subsurface or surface conditions, to adaptively optimize one or multiple aspects of the lifting system performance without a need for operator's intervention.

The disclosed invention provides a system and a method of optimization of an oil and gas well performance by employing adaptive control algorithms which take advantage of the unique compliance characteristics of hydraulic technology. By adapting its performance to specific well and environmental conditions in real time and in closed loop it increases power efficiency and productivity and reduces maintenance, with little or no need for an operator's intervention. Typical examples of operating dynamic conditions which require adaptation are load changes, inflow rate and inflow pressure changes, downhole output changes, well bore variation, temperature variation, wear, etc. The utilization of the adaptive control system of this invention is particularly important in remote locations where operator intervention is challenging.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the presented invention are described herein with reference to the drawings, it should be understood that such embodiments are by way of example only. They merely illustrate but a small number of the many specific embodiments which can represent applications of the principles of the present invention. Various changes and modifications, obvious to one skilled in the art to which the present invention pertains, are deemed to be within the spirit, scope and contemplation of the present invention as further defined in the appended claims.

The disclosed invention features an intelligent adaptive control system and method, used in conjunction with a long stroke hydraulic lift system, applied at the surface of an oil well, or a gas well, to pump fluid or gas. When used with an oil well the system is used to extract a mixture of oil, gas and water. When used with a gas well the system is used to remove water from the well (dewatering) to free up flow of gas.

In further detail, the disclosed invention provides means and method to monitor and control motion of a reciprocating cylinder attached to a rod string and a downhole pump to lift fluids from oil and gas wells.

In further detail, the disclosed invention provides means to monitor and control motion of said cylinder in accordance with control laws embedded in algorithms in an electronic control unit.

In further detail, the disclosed invention provides means to monitor and control motion of said cylinder in real time and in closed loop, according to a predicted model to optimize productivity of the well, predicted model based on specific well conditions.

In further detail, the disclosed invention provides means to monitor and control motion of said cylinder under changing well conditions, wherein control laws identify such conditions and adjust motion parameters accordingly.

In further detail, the disclosed invention provides means to monitor and control motion of said cylinder under changing well conditions, wherein control laws identify such conditions, measure their persistence and adjust the model and the respective motion parameters respectively.

In further detail, the disclosed invention provides means to monitor and control motion of said cylinder under changing well conditions, wherein control laws identify such conditions as hazardous, and adjust the cylinder motion parameters to mitigate stress or damaging risks.

Figure 1:
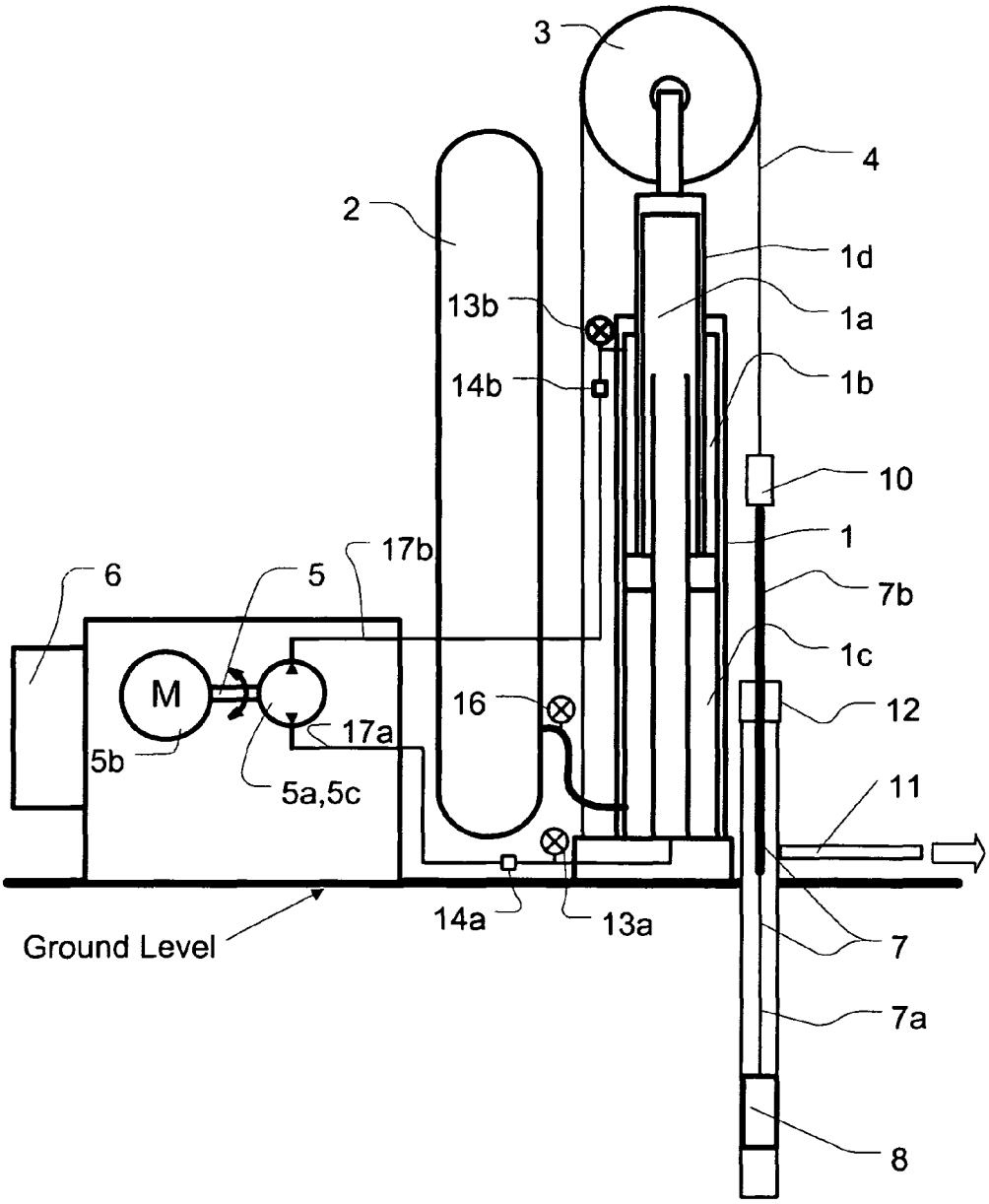
FIG. 1 is a schematic structural view of a typical embodiment of a surface mounted linear reciprocating hydraulic lift system, with a dual acting triple chamber hydraulic cylinder, for an oil well containing a mixture of oil, water and gas, or a gas well containing gas and water.

FIG. 1 illustrates a preferred embodiment of a rod lifting system applied with the disclosed adaptive control system invention. The preferred embodiment comprises three major components: A downhole pump 8, a rod string 7 and a surface mounted power source 1. In the preferred embodiment of the disclosed invention a surface mounted power source 1 reciprocates downhole pump 8 via means of rod string 7.

In further detail, said embodiment comprises a cylindrical downhole pump 8, which is submerged in the well bore fluid at a predetermined depth. Fluid and gas flow from the reservoir into the well bore through perforations in the well bore casing and into the downhole pump 8. By being reciprocated up and down, the downhole pump lifts (a) a mix of oil, water and gas in oil wells, or (b) water from gas wells; from the reservoir into flow lines 11 at ground surface, which route the fluids into separation tanks.

Figure 2:
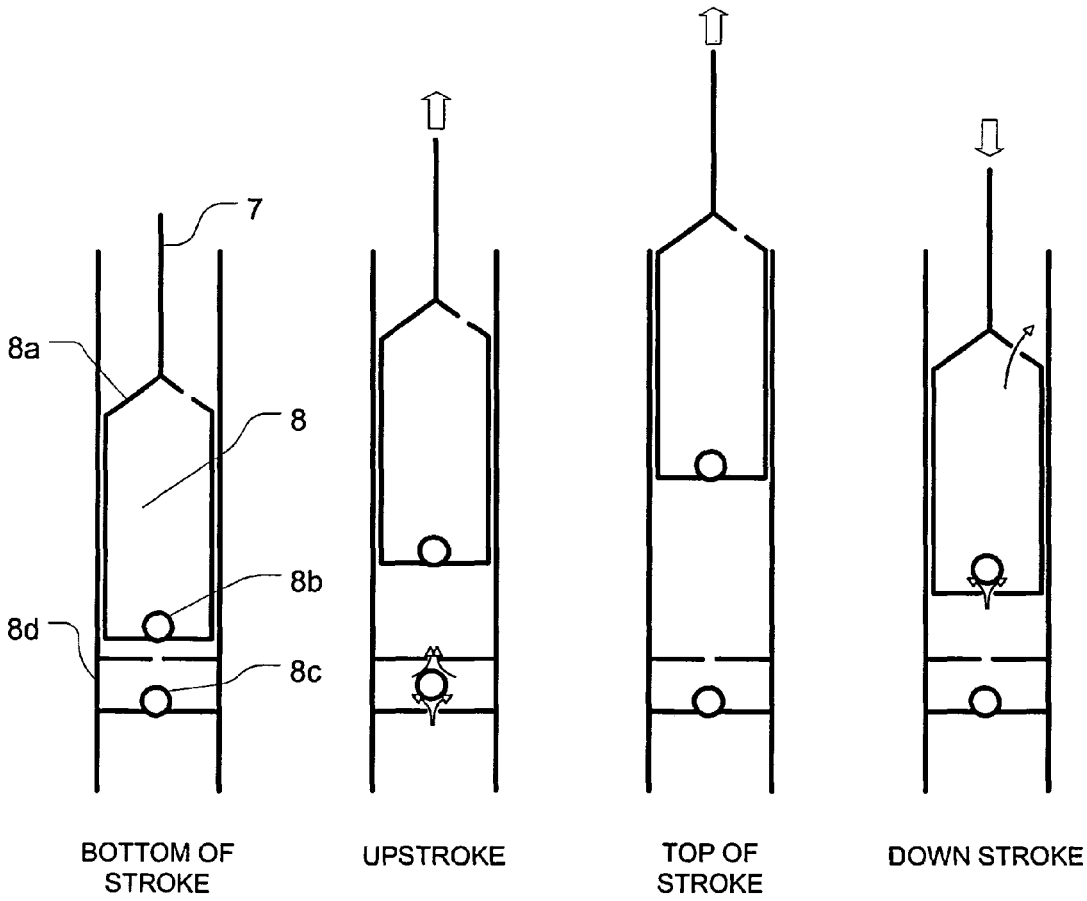
FIG. 2 is a schematic illustration of a typical embodiment of a sucker rod downhole pump and its operating cycle.

As illustrated in FIG. 2, said downhole pump comprises a plunger 8*a* working up and down in a closely fitted barrel 8*d*. A one-way valve 8*b*, also known to those familiar with the art as a "traveling valve", is positioned at the bottom of said plunger 8*a*, allowing flow only upward into said plunger 8*a*. A second one-way valve 8*c*, known also as a "standing valve", is positioned at the bottom of said barrel 8*d*, allowing flow only upward into said barrel 8*d*. As said downhole pump 8 is reciprocated up and down, said valves 8*b* and 8*c* open and close, filling fluid in said plunger 8*a* and pushing it up the well casing. The valves open and close by sheer differential head pressure of the fluid across the valves. Starting a pumping cycle with said plunger 8*a* rested on the bottom of said barrel 8*d*, both valves are closed. As the plunger starts moving up, said traveling valve 8*b* remains closed, while said standing valve 8*c* opens and allows flow into the growing cavity under the moving plunger. While said plunger 8*a* is on its up stroke, the fluid trapped above it is pushed up into the casing and into the flow lines 11. When said plunger 8*a* reaches its highest position, it stops, then reverses its direction down. At the top point the valves are closed. As said plunger 8*a* starts its down stroke, said standing valve 8*c* closes and said traveling valve 8*b* opens, allowing fluid to flow into said plunger 8*a*. When the plunger reaches its lowest down stroke point it stops and the valves close, ready to start a new pumping cycle.

In the preferred embodiment shown in FIG. 1 said rod string 7 transmits lift power from the surface mounted pumping unit 1 to downhole pump 8. Said rod string 7 comprises an assembly of threaded steel or fiberglass rods 7*a*, known to those familiar with the art as sucker rods. The uppermost portion of said rod string 7 is a polished steel rod 7*b* that is attached at its upper end to the surface mounted pumping unit through a carrier bar adapter 10. The lower part of the rod string is attached to said downhole pump plunger 8*a*. A stuffing box 12 seals the reciprocating said polished rod 7*b*, enabling it to reciprocate up and down in the fluid filled casing without leaking fluid out of the well head.

During pumping operation said rod string 7 and the attached said downhole pump 8 reciprocate up and down by means of a linear reciprocating cylinder 1. In a preferred embodiment, a pulley 3 is mounted on top of said cylinder 1. A cable 4 is wrapped around said pulley 3. As shown in FIG. 1, said cable 4 is fixed to one side of the pulley and attached at its other end to said polished rod 7*b* via carrier bar adapter 10. As said cylinder 1 and pulley 3 move up and down, cable 4 rolls on said pulley 3. While one side of said cable 4 is fixed, its other side that is attached to said carrier bar 10 moves up and down, in parallel with reciprocating cylinder 1. In said embodiment, parts attached to the moving side of said cable, namely said rod string 7 and said downhole pump, move at double the reciprocating speed of said cylinder 1 and double the stroke of said cylinder 1.

In a preferred embodiment shown in FIG. 1, said cylinder 1 is a dual acting triple chamber type. Said cylinder 1 comprises a piston 1*d* that reciprocates up and down by applying hydraulic flow and pressure alternatively to each side of the cylinder hydraulic ports. In said embodiment, hydraulic flow is provided to said cylinder 1 by a fixed displacement hydraulic pump 5*a* that is driven by an electric motor 5*b*. The coupled assembly of said electric motor 5*b* and said hydraulic pump 5*a* are defined hereinafter also as power train 5, as shown in FIGS. 1 and 3.

Said cylinder 1 comprises two hydraulic chambers: UP chamber 1*a* and DOWN chamber 1*b*, as shown in FIG. 1. When said hydraulic pump 5*a* rotates in one direction it pushes flow through hydraulic line 17*a* into said UP chamber 1*a*, pushing said piston 1*d* up. When said hydraulic pump 5*a* rotates in the other direction it pushes flow through hydraulic line 17*b* into said DOWN chamber 1*b*, pushing said piston 1*d* down. Hydraulic flow is gated to said UP chamber and DOWN chamber by means of manually or electrically operated shut off valves 14*a* and 14*b*, respectively. Hydraulic pressure is constantly monitored in said hydraulic chamber UP 1*a* and hydraulic chamber DOWN 1*b* by pressure sensors 13*a* and 13*b*, respectively.

In said embodiment said cylinder 1 comprises a third chamber 1*c* charged with gas. In said embodiment said gas chamber 1*c* is connected to a plurality of gas tanks 2 to provide a sizable volume of compressed gas, acting as a spring. Said gas chamber 1*c* provides counterbalance force to offset the gravity load of said rod string 7. By counterbalancing the dead weight of said rod string 7, the counterbalance feature enables sizing of said hydraulic power train 5 to lift only the fluid column weight, while the rod string weight is lifted by the counterbalance force. Thus, the said embodiment consumes the least amount of power required to lift only the useful weight. In said embodiment said counterbalance chamber 1*c* and said plurality of gas tanks 2 provide adequate volume to minimize gas pressure fluctuation during stroking of said cylinder 1.

Figure 3:
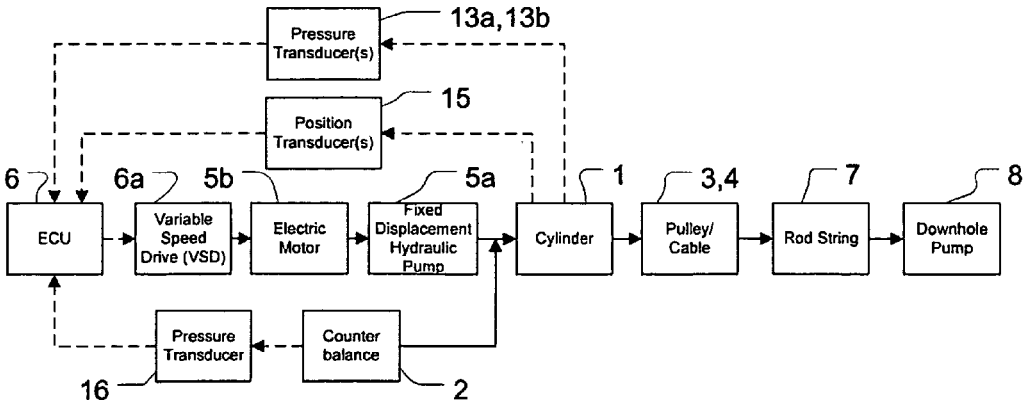
FIG. 3 is a schematic block diagram of a typical embodiment of a closed loop adaptive control system for an oil well, or a gas well, hydraulic lift system, using an electric motor, a variable speed drive and a fixed displacement hydraulic pump as its drive train.

In the embodiment shown in FIG. 3, motion of said cylinder 1 is powered and controlled by the flow rate and the direction of flow from said hydraulic pump 5*a* to said cylinder 1. With no flow the cylinder stops in place. In said embodiment, direction of motion of the cylinder, up or down, is determined by the direction of rotation of said hydraulic pump 5*a*. In said embodiment, said hydraulic pump 5*a* is a fixed displacement type, displacing a fixed volume of flow per turn to said cylinder 1, so that the flow rate is determined by the speed of rotation of said hydraulic pump 5*a*. In said embodiment the pump is directly coupled to an electric motor 5*b*, which transfers its output torque directly to the pump's input shaft. In said embodiment the speed of the motor and its direction of rotation are controlled by a variable speed drive (VSD) 6*a*, controlling the voltage and the frequency of AC power to said electric motor 5*b*. An Electronic Control Unit (ECU) 6 commands said VSD 6*a* to produce speed input parameters to said electric motor 5*b*. Command inputs to said VSD 6*a*, determine the motion profiles of said cylinder 1 and said downhole pump 8. Command signals are compiled in the ECU by a set of control laws and in accordance with a set of input parameters, collected perpetually by sensing devices of the system, to provide desired outputs of the pumping system.

Ideal pumping occurs when inflow rate of the downhole pump equals the pumping rate, with the downhole pump being fully submerged in fluid to allow complete filling of the downhole pump in each stroke. Furthermore, it is desired to move the fluid column on the up stroke as fast as possible in order to maximize production while minimizing leakage losses during the lifting phase.

It is also desired to move downward at a maximum speed allowing filling of the downhole pump at the fastest rate without creating a pounding effect.

Ideal acceleration and deceleration rates at the up and down turnarounds occur when their durations are minimized without creating peak loads which may overstress the system. The ability to fully monitor and control the position of the cylinder at any point and at any time enables also concurrent control of its speed and acceleration. Control of these parameters is fundamental to optimization of the pumping speed and to the productivity of the well. Production can be, maximized by increasing the speed of the cylinder to move at the fastest rate without pumping off the well and without creating pounding on its down stroke.

This objective is accomplished by employing the disclosed adaptive control system and method described herein. First, based on the well conditions and the inflow rate, an ideal model of motion is created in the ECU, to become the desired optimal motion profile for a specific well that will produce maximum flow. The ideal model is based on parameters such as, but not limited to, the desired production rate, the given well depth, the well inflow pressure, the well fluid type and composition, the pumping equipment characteristics, etc.

Additional characteristics such as downhole pump leakage and well friction are acquired by initial testing of the well. Based on this data, an ideal model of pumping loads versus pump stroke, known to those familiar with the oil industry as a model Dynamometer card, is created, along with a kinematic profile, characterizing position, velocity and acceleration at every point. The model includes surface load, as well as subsurface load, versus stroke characteristics (surface Dynamometer card, as well as downhole Dynamometer card). Additional operating boundaries are defined in the model to address deviations from nominal values of the model due to changing conditions of the well. Typical changes in operating conditions include profiles of, for example, well pump off conditions, start up conditions, gas build up conditions, pounding, excessive friction, changes in surface pressure, rod separation, etc. A set of control laws addresses ideal operating conditions, as well as deviation cases, by adjusting the cylinder's motion parameters respectively.

As the pumping system starts operating, its position, velocity, acceleration and loads are monitored or calculated and compared to the models. Position feedback said cylinder piston 1*d* is provided to said ECU 6, for example, by at least one position transducer 15. Momentary hydraulic pressure in said cylinder's hydraulic chambers 1*a* and 1*b* are acquired by pressure sensors 13*a* and 13*b* respectively. Momentary pneumatic counterbalance pressure in cylinder chamber 1*c* is acquired by pressure sensor 16. Said pressures are fed to said ECU 6 to calculate momentary rod string loads and fluid column loads. Momentary loads are calculated by multiplying the measured pressures by the respective cross section areas of each chamber and by the stroking ratio of the cylinder and the downhole pump. In the preferred embodiment, which includes said pulley 3, this ratio is 1:2. In another embodiment, rod string load feedback can be provided by a load cell attached directly to said polished rod 7*b*.

Figure 6:
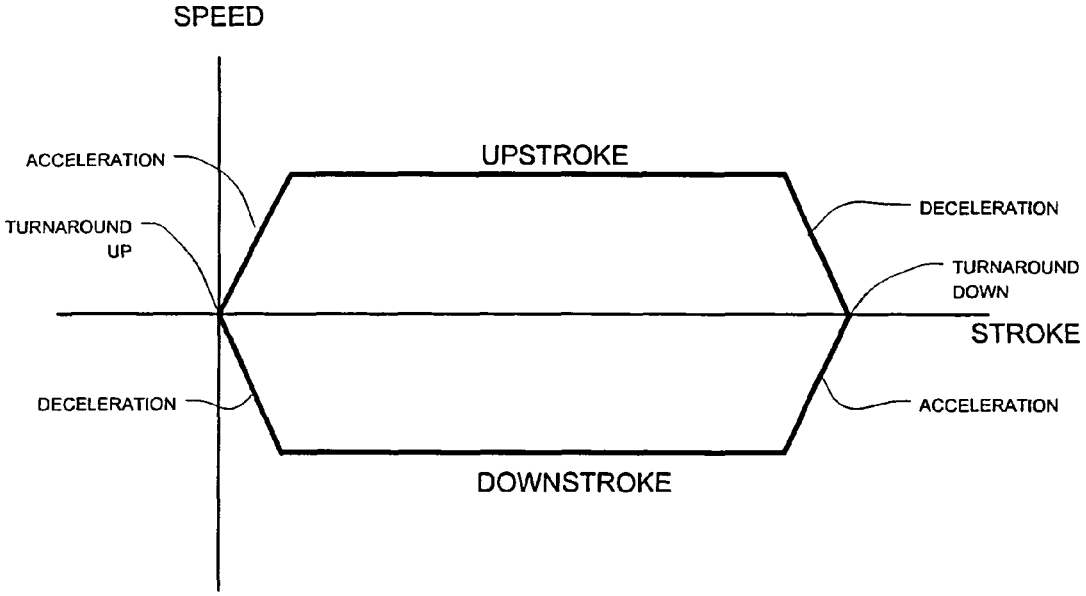
FIG. 6 shows a typical graph of cylinder velocity versus cylinder stroke in a characteristic embodiment of the invention.

Furthermore, it is well known in the oil industry that, due to their sinusoidal motion, beam pumps demonstrate high loads at the turnaround points of their reciprocating cycle without having real provisions to overcome these loads. The disclosed invention easily enables mitigation of the high inertia loads created at the turnaround points of the cylinder. Turnaround loads are reduced, creating a soft reversal of the cylinder's direction, by fine tuning the slowdown and ramp up velocities (deceleration and acceleration at the turnaround points). The ability to automatically reduce loads and stresses has a direct and immediate improving impact on the durability and longevity of the entire pumping system. FIG. 6 illustrates a speed versus stroke characteristic graph of the disclosed invention. Starting a pumping cycle at the bottom, the cylinder starts moving up at a set acceleration rate until it reaches a preset optimal up speed. The cylinder continues to move up at this speed until it reaches a predefined distance from the top. At this point the cylinder starts decelerating until it comes to a stop. At the top of its stroke the cylinder reverses its direction down, accelerating its speed until it reaches a desired down speed. The cylinder moves down at constant speed until it reaches a certain distance from the bottom. At this point the cylinder decelerates its speed until it comes to a stop. The cylinder's speed is fully controlled by the ECU at each segment of its stroke. The cylinder's up speed and its down speed can be set at different values, as well as each acceleration and deceleration value along each segment of its stroke.

Ideally, duration of the acceleration and deceleration phases are set to minimum, enabling the cylinder to travel at constant speed through a majority of its stroke length. However, the acceleration values, primarily on the upstroke can be adjusted in order to dampen inertia loads and excessive stress and wear.

Initially, optimal speed on the up stroke is set at the maximum speed that will not cause (a) pumped off condition of the well, or (b) overstressing of the sucker rods and its associated structural components. Maximum speed on the upstroke also minimizes the leakage of produced oil, thereby increasing production efficiency.

Optimal speed on the down stroke is set at the maximum speed which will not cause floating of the polished rod. Floating of the polished rod on the down stroke can cause separation of the polished rod from the carrier bar, leading to uncontrolled impact loads between them when they come back together on the up stroke.

Figure 7:
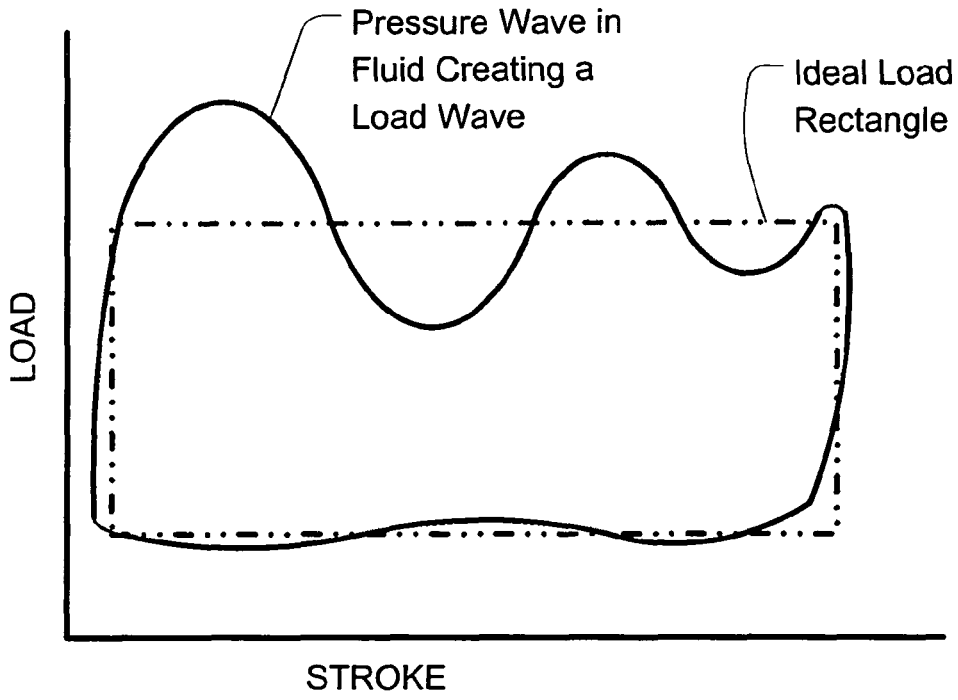
FIG. 7 shows a typical Dynamometer card of a load wave created by a traveling pressure wave in the fluid column by the fluid inertia, occurring frequently in shallow wells.

Deviations from the ideal model are calculated and processed to command the pump to adjust its motion parameters to converge closely towards the desired optimal performance. For example, shallow wells demonstrate frequently fluid inertia load waves, as shown in FIG. 7, which cause excessive stressing of the pumping system components. Controlled adjustments of the cylinder's speed and acceleration on the up stroke can attenuate the load wave traveling along the rod string and reduce the peak inertia loads the wave creates.

Furthermore, the disclosed invention is a self teaching system. As well conditions may change over time, the control algorithms of the disclosed invention measure persistence of such new conditions. If the measured conditions are determined to be persistent, the control laws create a modified model matching the new operating conditions, and optimizing the performance of the system operating parameters to the new model. For example, a persistent change in inflow pressure may trigger a modification of the current model by changing operating parameters such as the down stroke speed and acceleration. As inflow to the well bore declines over time, continuous operation at higher than the optimal speed causes pumped off conditions, with partial fillage of the downhole pump. Operation in pumped off conditions is causing pounding loads between the pumping equipment and the fluid, resulting in overstressing of structural parts, their premature damage, high maintenance costs and shorter life of the pumping equipment. The disclosed invention in its presented embodiments enables to slow down the production rate almost indefinitely, automatically or manually by a stroke on a keyboard. The disclosed invention provides thus simple means to maintain an ideal pumping rate, which equals the inflow rate, with the downhole pump being completely filled on every stroke. Further slowdown under severe pumped off conditions is enabled by operating in an intermittent mode.

Furthermore, in extreme deviations from normal operation, the control laws of the disclosed invention revert the pumping system to different modes of operation in accordance with preset algorithms. For example, an abnormal low load feedback signal to the ECU, indicating a potential structural failure of the rod string, stops immediately the cylinder from extending rapidly due to counterbalance force, thereby avoiding harsh impact loads of the piston against the cylinder head. In another example, the cylinder stroke may be adjusted from reciprocating at full stroke to reciprocating only for a partial stroke length, as well as limiting the stroke to a particular zone along the stroke. The cylinder stroke can be adjusted automatically, or manually using a simple keyboard command, when a certain zone along the stroke of the downhole pump shows problems such as excessive friction.

Under all operating conditions, a local or remote operator has the ability to override the self adaptive system, providing the operator full control of the lifting system. Intervention of an operator is enabled by direct or remote interface with the ECU.

Figure 8:
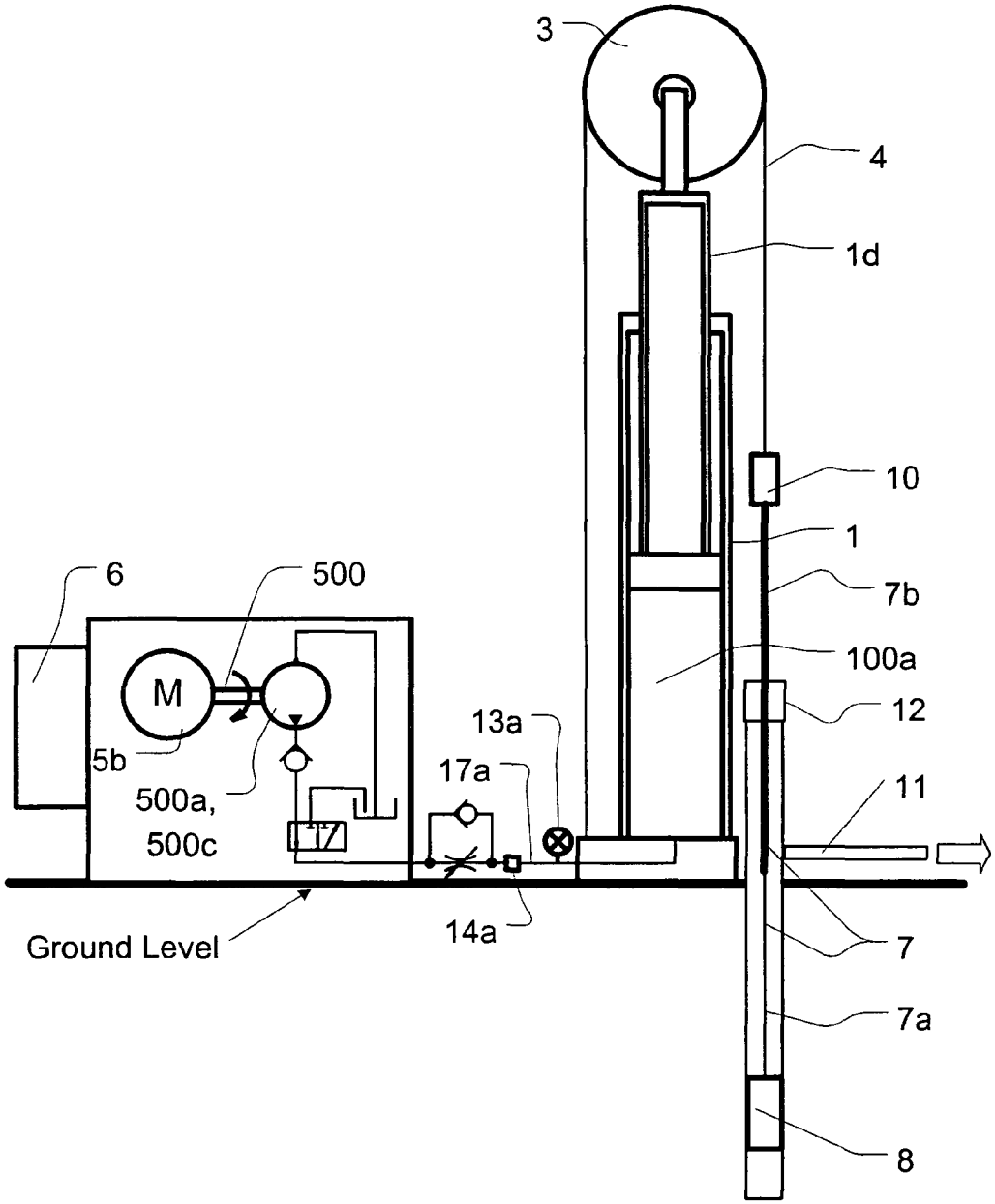
FIG. 8 is a schematic structural view of a typical embodiment of a surface mounted linear reciprocating hydraulic lift system, with a single acting hydraulic cylinder, for an oil well containing a mixture of oil, water and gas, or (b) a gas well containing gas and water.

The triple chamber cylinder is not critical to the invention and other cylinder embodiments can be utilized with the disclosed invention. FIG. 8 illustrates an alternative embodiment of the disclosed adaptive control system invention, comprising a single acting cylinder, using hydraulic flow and pressure to move said cylinder piston 1*d* up, while gravity of said rod string 7 and said downhole pump 8 move the pump down. In said embodiment, said cylinder 1 has a single hydraulic UP chamber 100*a*, which when pressurized pushes said cylinder piston 1*d* up. A unidirectional hydraulic pump 500*a* supplies flow and pressure to said UP chamber 100*a*. When said cylinder piston 1*d* reaches its stroke top, hydraulic flow to UP chamber 100*a* ceases, hydraulic pressure is relieved and said cylinder piston 1*d* is pulled down by the weight of said rod string 7 and downhole pump 8.

Figure 4:
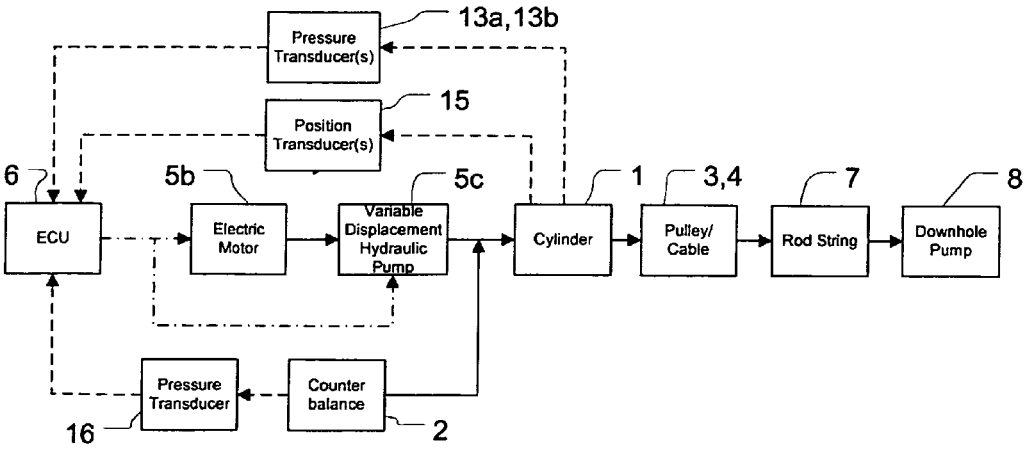
FIG. 4 is a schematic block diagram of a typical embodiment of a closed loop adaptive control system for an oil well, or a gas well, hydraulic pumping system, using an electric motor and a variable displacement hydraulic pump as its drive train.

FIG. 4 illustrates an alternative embodiment of the disclosed adaptive control system invention, comprising a hydraulic cylinder operated by a primary drive train, including a plurality of electric motors 5*b*, powered by grid power or by auxiliary generators and a plurality of variable displacement hydraulic pumps 5*c*, said hydraulic pump 5*c* providing flow and pressure to a hydraulic cylinder 1. In this embodiment the electric motor is operating at constant speed. Hydraulic flow to said cylinder 1 is controlled by ECU 6 which adjusts directly the volumetric displacement of said hydraulic pump 5*c*, thereby adjusting the pump's flow.

Figure 5:
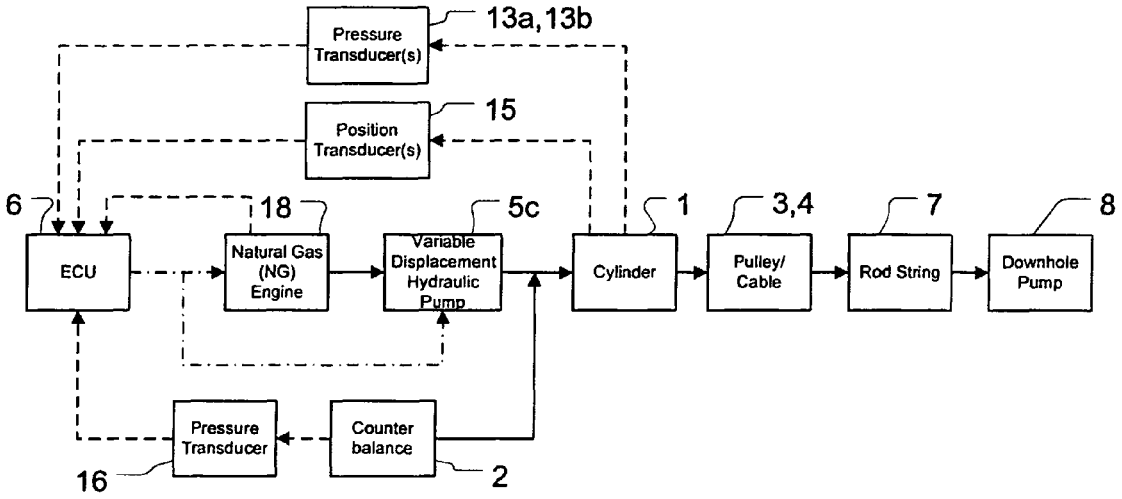
FIG. 5 is a schematic block diagram of a typical embodiment of a closed loop adaptive control system for an oil well, or a gas well, hydraulic pumping system, using a combustion engine and a variable displacement hydraulic pump as its drive train.

FIG. 5 illustrates an alternative embodiment of the disclosed adaptive control system invention, comprising a hydraulic cylinder operated by a drive train, comprising a natural gas (NG) engine 18, driving a variable displacement hydraulic pump 5*c*, said hydraulic pump 5*c* providing flow and pressure to cylinder 1. In this embodiment the natural gas engine is operating at constant speed. Hydraulic flow to said cylinder 1 is controlled by ECU 6 which adjusts directly the volumetric displacement of said hydraulic pump 5*c*, thereby adjusting the pump's flow.

The terms and examples employed herein are meant as a description and not a limitation to the scope of the invention. The drawings are meant to be illustrative and are not intended to limit the scope of the invention disclosed. No element described herein is required for the practice of the invention unless it is described as essential or critical. The invention should therefore not be limited by the above described embodiments, methods and examples, but by all embodiments and methods within the scope and spirit of the invention as presented herein.

What is claimed is:

1. An oil well pumping system comprising:

a. a cylinder using hydraulic fluid flow and pressure to reciprocate a cylinder piston up and down;

b. a drive train providing flow and pressure to the cylinder;

c. a mechanism for coupling the reciprocating cylinder piston to a rod string which includes a polished rod and sucker rods connected to a downhole pump to remove a mixture of oil, water and gas located in a well bore;

d. at least one position transducer continuously measuring the position of the cylinder piston along its stroke;

e. an electronic control unit (ECU) including a computer controlling fluid flow to the cylinder through control of the drive train speed to thereby continuously control real time motion of the cylinder piston in accordance with preset algorithms;

f. a predictive theoretical model of loads and speeds versus stroke based on desired production, well conditions, downhole pump, rod string and surface mounted pump characteristics, providing optimal production performance at given conditions, the information input to the ECU;

g. a set of control laws comparing actual real time data with the theoretical predictive model and providing corrective signals to the ECU to maximally approximate actual performance to the predictive theoretical model h. said computer connected to and collecting real time data from a plurality of sensors measuring well and pumping parameters selected from a group consisting of fluid level in the well bore, downhole and surface fluid pressure, real time position of the cylinder piston, hydraulic pressure in the cylinder, hydraulic fluid level in a hydraulic reservoir, hydraulic fluid temperature and hydraulic fluid cleanliness;

i. the computer continuously monitoring stroke length of the reciprocating cylinder piston, direction, position, speed, acceleration and deceleration of the reciprocating cylinder piston and continuously adjusting the speeds of the reciprocating cylinder piston to maximize up stroke speed, minimize acceleration and deceleration phases while minimizing peak inertia loads and maximizing the up and down stroke speeds until the level of the mixture of oil, water and gas reaches the down hole pump;

j. the computer optimizes the down stroke speed to allow complete fillage of the downhole pump, slows down the pump's speed when persistent incomplete fillage is detected and operates intermittently when further slow down becomes impossible;

k. the computer brakes the cylinder piston and lands softly in the case of a rod separation failure when an abnormal low sucker rod load is detected;

l. the computer reverses the up stroke motion when abnormal high rod string loads are detected;

m. the cylinder is a dual acting triple chamber hydro-pneumatic cylinder, comprising an up hydraulic chamber wherein hydraulic fluid is forced into the up chamber and causes the cylinder piston to move upwardly, a down hydraulic chamber wherein hydraulic fluid is forced into the down chamber and causes the cylinder piston to move downwardly, and a third counterbalance gas chamber into which gas is fed to counterbalance to the dead weight of the rod string;

n. said computer connected to and collecting real time data from a plurality of sensors measuring pressure in the cylinder's up hydraulic chamber, down hydraulic chamber and counterbalance gas chamber;

o. the drive train comprises a hydraulic pump connected to said hydro-pneumatic cylinder, the hydraulic pump is a fixed displacement pump displacing a fixed volume of hydraulic fluid per turn of the pump, the hydraulic pump connected to an electric motor which transfers output torque to the pump's input shaft, the electric motor direction of rotation and speed controlled by a variable speed drive controlling voltage and frequency of AC power to the electric motor, the direction of rotation of the hydraulic pump causing hydraulic fluid to flow into the cylinder up chamber and move the cylinder piston in the up direction, rotation of the hydraulic pump in the opposite direction causing hydraulic fluid to flow into the cylinder down chamber and move the cylinder in the down direction, the ECU commanding the variable speed drive to produce direction of rotation and speed input parameters to the electric motor; and p. the mechanism for coupling the reciprocating cylinder piston to the sucker rod includes a pulley attached to the reciprocating cylinder piston, the pulley having a cable wrapped around the pulley, the cable fixed at one end to a stationary point, the other end of the cable connected to the rod string.

* * * * *